United States Patent [19]

Lazure

[11] 4,170,862

[45] Oct. 16, 1979

[54] METHOD OF AND APPARATUS FOR MANUALLY CLOSING FOIL CONTAINERS AND TOOL THEREFOR

[75] Inventor: Frank S. Lazure, Richmond, Va.

[73] Assignee: Reynolds Metals Company, Richmond, Va.

[21] Appl. No.: 923,173

[22] Filed: Jul. 10, 1978

[51] Int. Cl.[2] ..... B65B 7/28

[52] U.S. Cl. ..... 53/471; 53/486; 53/366; 53/390; 81/3 R; 113/1 E; 113/24 H

[58] Field of Search ..... 53/471, 486, 363, 366, 53/341, 334, 390; 81/1 R, 3 R; 113/1 D, 1 E, 1 F, 24 H

[56] References Cited

U.S. PATENT DOCUMENTS

| | | | |
|---|---|---|---|
| 2,784,543 | 3/1957 | Barr | 53/334 |
| 2,845,765 | 8/1958 | Doherty | 53/366 |
| 3,369,342 | 2/1968 | Tessitore | 53/366 |
| 3,905,174 | 9/1975 | Heisler | 53/329 X |

*Primary Examiner*—Travis S. McGehee

*Attorney, Agent, or Firm*—Glenn, Lyne, Girard, Clark and McDonald

[57] ABSTRACT

A method of and apparatus for manually closing foil containers of the type having a generally horizontally extending shoulder for supporting a closure lid and an upstanding closure flange which is foldable over onto a closure lid. A hand-held tool is employed in combination with a closure die member which holds the container in stable condition during the closing operation. The tool has a key means which is inserted into a mating track in the die member which surrounds the pocket means of the die member. The tool is advanced within the track and effectively plows the upstanding closure flange down onto the upper surface of the closure lid thereby effecting a closure.

18 Claims, 8 Drawing Figures

METHOD OF AND APPARATUS FOR MANUALLY CLOSING FOIL CONTAINERS AND TOOL THEREFOR

BACKGROUND OF THE INVENTION

This invention relates to a method of and apparatus for manually closing foil containers and a tool therefor and, more particularly, to such a method and apparatus employing a hand-held tool which progressively folds an upstanding flange of the container onto the upper surface of a plug-type lid received on a shoulder of the container.

The types of containers to which the invention is most readily adaptable comprise round, elliptical and rectangular aluminum foil containers that have an upstanding vertical flange used to secure a flat paperboard or foil laminated to paperboard lid to an upper shoulder on the container. The vertical flange is folded over the edge of the lid to effect the closure.

A number of manual closing devices have been employed in the past, but because of their cost or their inability to do the job efficiently and on different sized containers they have not fully satisfied certain elements of the trade, for example caterers and small delicatessen stores. One such device consists of a hinged mating die-set and while it does an excellent job, it is relatively expensive. Furthermore, there is a limit on the size of the container that this type of machine will accommodate because of a limitation on the manual pressure that can be exerted. The known hand tools do not perform sufficiently well to be useful.

SUMMARY OF THE INVENTION

The present invention effectively overcomes the foregoing shortcomings and difficulties of the known prior art by providing a novel method and apparatus for closing foil containers having an upstanding vertical flange with a unique hand-held tool therefor.

In particular, the apparatus of the present invention includes an inexpensively manufactured closure die member and a hand-held tool to be used in conjunction therewith. The die member is provided with pocket means or a cavity which receives the container and maintains it in a stable condition during the closing sequence. The die member is also provided with track means or a guide groove which extends around the periphery of the pocket means and which functions to guide the hand-held tool member throughout the closing sequence.

The tool member itself is composed of a handle and a base member or work anvil. The handle is made rotatable with respect to the base member or work anvil whereby camming means provided on the base member can follow the turns in or the curvature of the track means. The camming means effectively plows the container flange inwardly and downwardly onto the upper surface of the closure lid. The base member or work anvil is provided with a key means or plug member which is inserted into the track means of the die member so as to follow the predetermined path thereof in making the closure. In a preferred form of the invention, this key means also orients the tool member so that the camming means is in proper position to fold the upstanding flange of the container onto the plug lid to effect a closure.

In practicing the method of the present invention for closing foil containers of the type having a generally horizontally extending shoulder for supporting a closure lid and a upstanding closure flange foldable over onto the closure lid, the following method steps are employed:

(1) filling the container with a product;

(2) placing a closure lid for the container on the generally horizontally extending shoulder of the container;

(3) inserting the container into a pocket means of a die closure member;

(4) progressively folding the upstanding flange of the container in a single direction onto the closure lid by means of (a) inserting a hand-held closure tool in track means on the die member which surround the pocket means;

(b) and camming the upstanding flange means of the container onto the upper surface of the closure lid by advancing the tool member in the track means.

The order in which steps 1–3 listed above occur is not critical. For example, the container could be inserted into the pocket means of the die closure member, then filled with a product and then have the closure lid member placed in position.

Two ancillary steps of the method invention include the following:

(1) preventing the container (if it is round) from rotating while the tool member is being advanced, by lining the pocket means with a non-skid surface such as is provided by resilient polyurethane buttons and;

(2) manually folding down a portion of the upstanding flange of the container immediately adjacent the cam means on the tool member so as to start the plowing of the container flange onto the upper surface of the plug lid closure member.

DESCRIPTION OF THE PREFERRED EMBODIMENT

Figure 1:
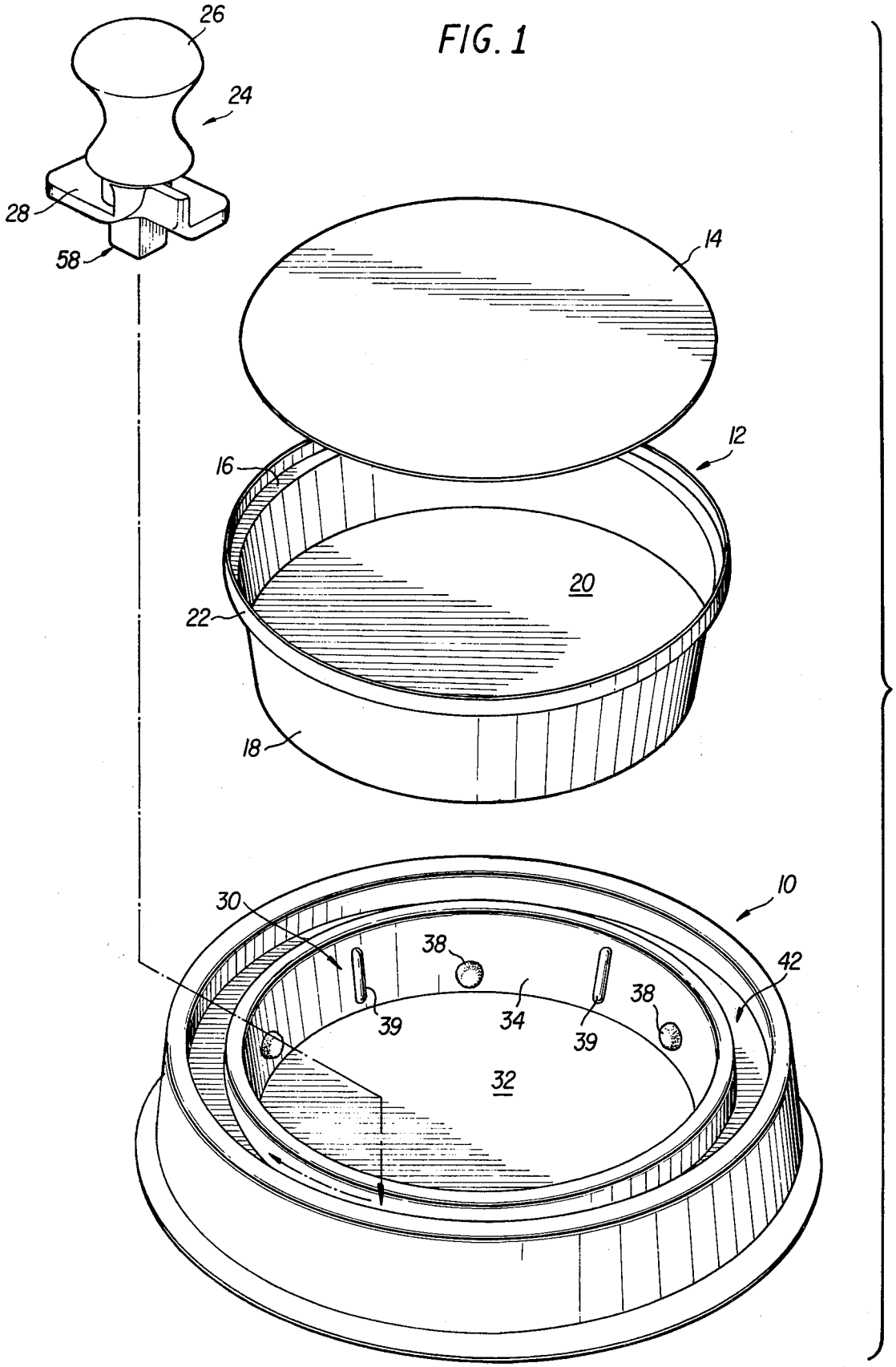
FIG. 1 is an exploded perspective view illustrating one form of closure die for a container and lid therefor with a closure tool of the present invention.

Referring now to FIG. 1 of the drawings, there is illustrated a closure die member, indicated generally at 10, and an aluminum foil container, indicated generally at 12. A plug closure lid 14 is adapted to be inserted into container 12 so as to rest on a generally horizontally extending shoulder 16 which extends circumferentially around the top of a side wall 18. A bottom wall for the container is shown at 20. This container 12 is further shown to have an upstanding vertical flange 22. Although flange 22 is illustrated in FIG. 1 to have what is known in the trade as a hemmed edge, the flange 22 may be raw, curled or combinations of any of the foregoing and still fall within the purview of the present invention.

A hand-held tool member is indicated generally at 24 comprising a handle 26 rotatable mounted on base member or work anvil 28 in a manner described hereinafter. The tool member 24 is completely separate from the closure die member 10. For purposes of clarity, the scale used to depict the hand-held tool 24 is greater than the scale used in illustrating container 12, for example.

Figure 2:
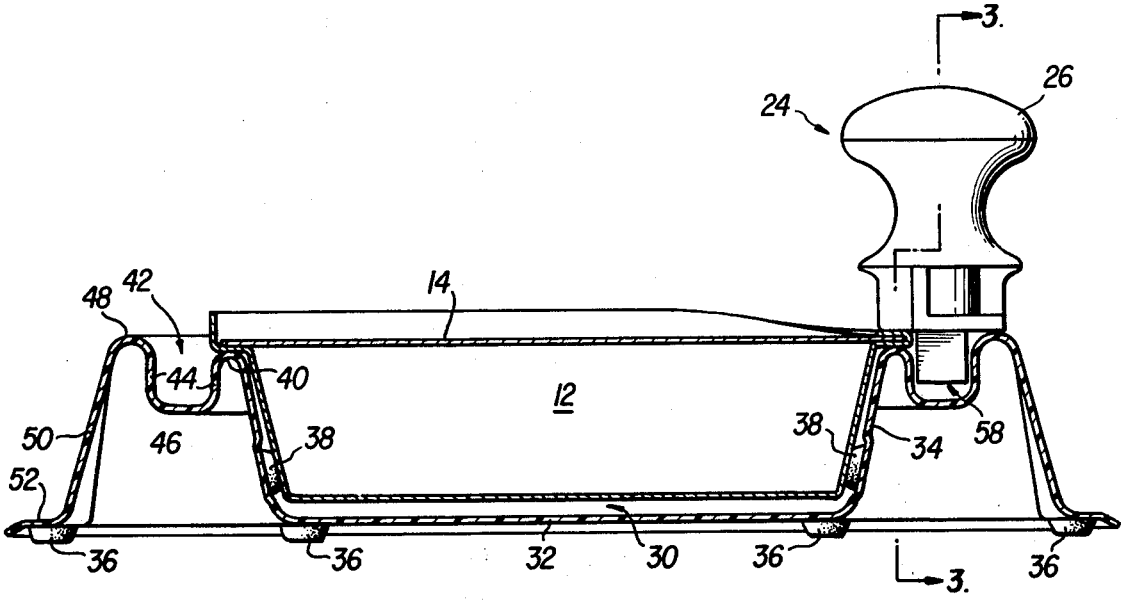
FIG. 2 is an elevational view taken in vertical cross section showing the elements of FIG. 1 during a closure operation.

Referring now to FIG. 2 in combination with FIG. 1, the closure die member 10 is illustrated in FIG. 2 to have a pocket means or cavity 30 formed by bottom wall 32 and an interior wall 34. While the closure die member is illustrated to have a single pocket means 30 it is evident that additional pockets of the same of different size could be employed.

In plowing over a vertically upstanding flange rotation of the closure die member for the container must be prevented. To that end, the closure die member 10 is illustrated to have a plurality of rubber buttons 36 for engagement with a work surface. Alternatively, a pad means may be used to provide a non-skid engagement with a work surface in place of the plurality of rubber buttons 36 or the die member could be screw fastened or otherwise secured to a work surface if portability of the closure die member is not a factor.

If the container is round, rotation of the container within the closure die member must also be prevented. Such rotation is preferably prevented by providing within pocket means 30 a plurality of buttons 38 having a high coefficient of friction with respect to aluminum. If desired the wall 34 may also be provided with ribs or flutes 39 to inhibit rotation of a round container.

The closure die member 10 is also provided with means to support the generally horizontally extending shoulder 16 of the foil container and this is shown in FIG. 2 to take the form of a ledge 40 surrounding the pocket means 30. A track means or guide groove indicated generally at 42 is provided externally of the means for supporting the generally horizontally extending shoulder of the container. This track means comprises a channel exterior to ledge 40 formed by opposed side walls 44 and a bottom wall 46. The additional structure of the closure die member consists of an exterior top wall 48, a sloping exterior wall 50 and a flange 52 for attachment of rubber buttons 36 or other suitable means for anchoring the closure die member 10.

Figure 3:
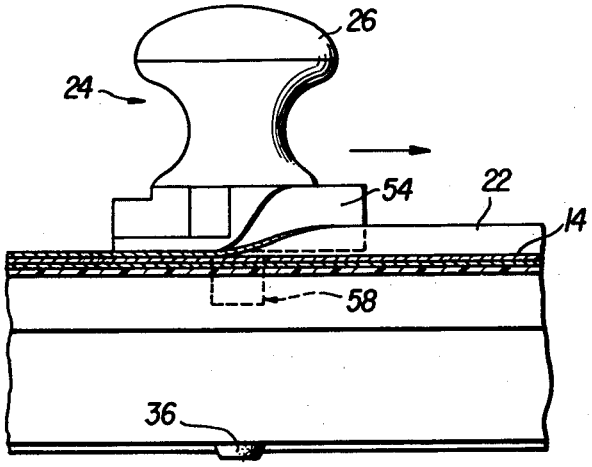
FIG. 3 is a fragmentary elevational view taken in vertical cross section along line 3—3 of FIG. 2.
Figure 4:
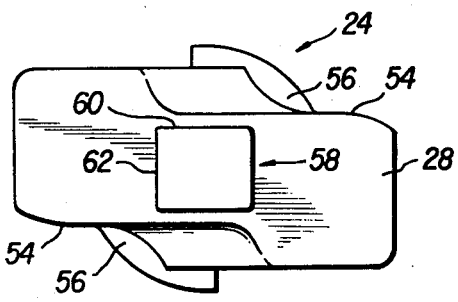
FIG. 4 is a bottom view of the hand held closure tool.
Figure 5:
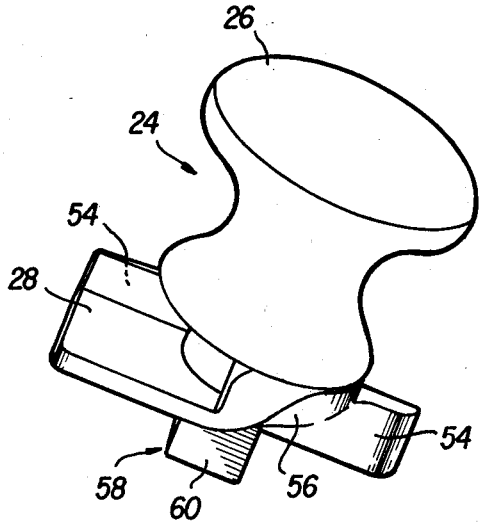
FIG. 5 is a perspective view of the hand held closure tool.
Figure 6:
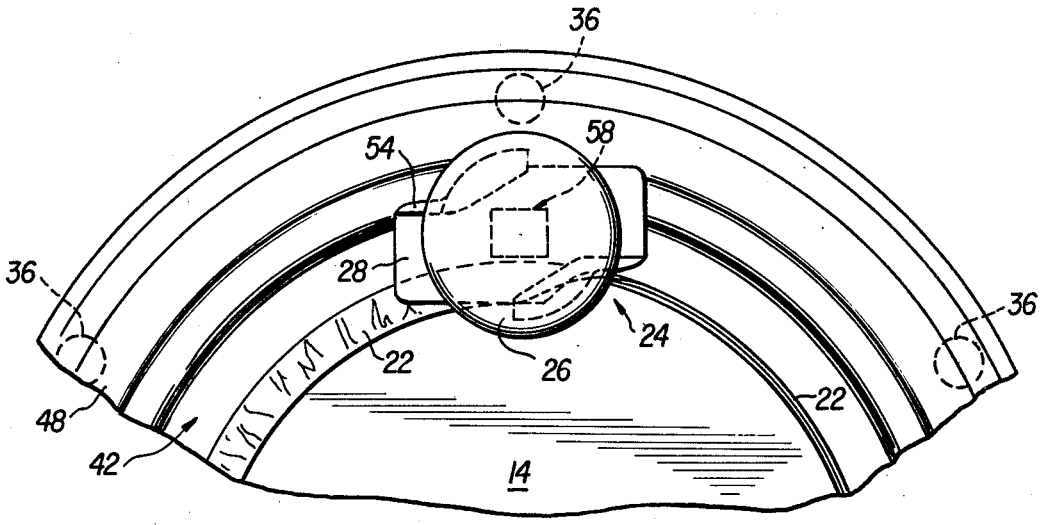
FIG. 6 is a fragmentary top plan view of a portion of FIG. 2.

Referring now to FIGS. 3–6, the details of the hand-held tool member 24 and its operation may be perceived. The plowing down of the vertical flange 22 of the container is best illustrated in FIG. 3. To that end, tool member 24 has a first camming surface 54 on a vertically extending deflecting wall and a second camming surface 56 on a plow-like member each of which extend above the substantially rectangular base member 28. Each opposed diagonal corner of the base member 28 has a pair of camming surfaces 54 and 56.

The tool member 24 also has key means or plug member indicated generally at 58 which is so arranged and constructed to orient the tool member within the track means 42. In particular, the key means 58 is formed from a hollow extension, rectangular in cross section, with one pair of opposed sides 62 so as to permit insertion of the key means 58 into the track means 42 with the longer opposed sides parallel to the opposed walls 44 which help to form the track means or guide groove 42.

Figure 7:
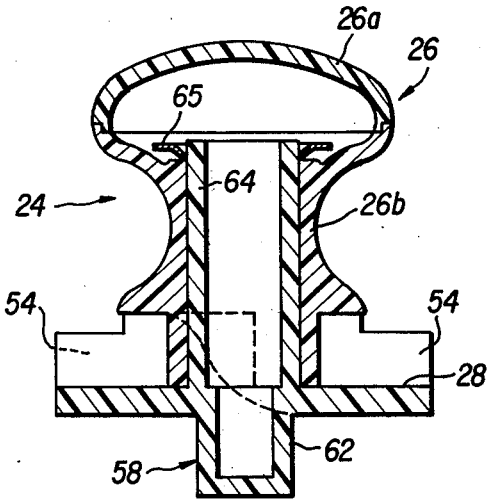
FIG. 7 is an elevational view of the hand held closure tool taken in vertical cross section.

As can be seen best in FIG. 7, the base member or work anvil is provided with a hollow central post 64 which extends vertically upwardly from the surface of base member 28. The gripping portion of handle 26, as shown in FIG. 7, is actually made from two portions, namely a top cap member **26*a* and a hollow base portion 26*b* through which the central post 64 extends. A round lock ring 66 secures the two portions of handle 26** together while permitting one portion to rotate with respect to the other.

Figure 8:
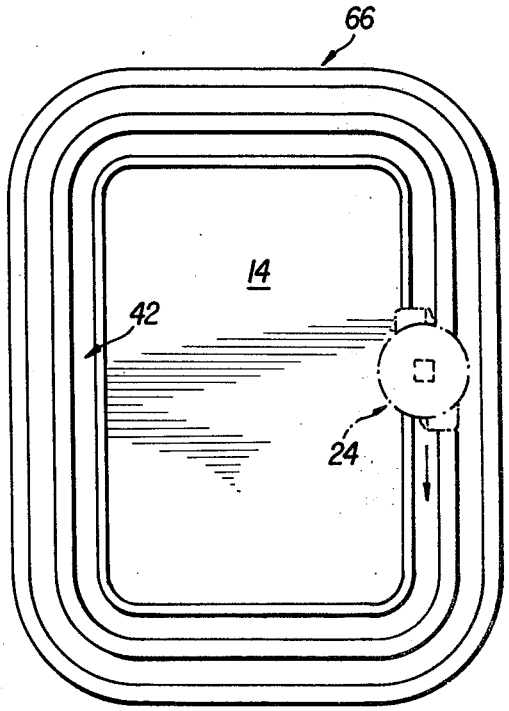
FIG. 8 is a top plan view illustrating a rectangular container and closure die.

A modified form of the present invention is illustrated in FIG. 8 wherein there is shown a rectangularly shaped container and die configuration indicated generally at 66. Except for the difference in contour of the pocket means to accomodate a rectangular container and the associated track means extending peripherally therearound, this modification resembles the previously illustrated embodiment and the hand-held tool member 24 is serviceable in both modifications of the invention. Thus with the present invention, the container may be round, rectangular, elliptical or other cross sectional shape.

In operation, the container 12 with an upstanding vertical flange 22 is inserted into the pocket means 30 of closure die 10, is filled with a product and a closure lid 14 is placed on the horizontally extending shoulder 16 of the container. The sequence of these first three steps, as has been pointed out previously, is not critical with the filling of the container either preceding or following the insertion of the container into the pocket means. Thereafter, the upstanding flange of the container is progressively folded in a single direction onto the closure lid by means of inserting the hand-held closure tool 24 into the track means 42 which surrounds the pocket means 30 and camming the upstanding vertical flange 22 by means of one set of the camming surfaces 54, 56 provided on the tool 24 onto the upper surface of the closure lid by advancing the tool member in the track means surrounding the pocket means. The key member 58 orients the hand-held closure member 24 with respect to the upstanding vertical flange of the container. As an additional step, the user can manually fold down a portion of the upstanding flange of the container with his finger immediately adjacent the cam means on the tool member before beginning to advance the tool member in the track means to avoid buckling of the thin and relatively fragile upstanding vertical flange. The aluminum foil thickness range is normally less than about 0.006 inches, but it will be understood that the term "aluminum foil" as used herein also includes aluminum of greater thickness formed into containers of the type described.

The tool member 24 is preferably made from a material providing sufficient lubricity to move around the container and fold the flange down in a smooth manner. For example, an acetal sold under the trademark "Delrin" or nylon sold under the trademark "Zytel" each by E. I. Du Pont de Nemours of Wilmington, Del., has been found to be satisfactory. At least, the camming surfaces 54, 56 of the hand-held tool member should be made from a material having a low coefficient of friction on aluminum and substantial lubricity and wear resistance. The invention is also applicable to a domed plastic lid as well as to the illustrated flat lid. The closure die member can be fabricated of plastic by thermoforming, blow molding, pressure molding, or injection molding or it could conceivably be press formed from sheet metal.

While presently preferred embodiments of the invention have been illustrated and described, it will be recognized that the invention may be otherwise variously embodied and practiced within the scope of the claims which follow. What is claimed is:

1. An apparatus for closing foil containers of the type having a generally horizontally extending shoulder for supporting a closure lid, a closure lid received on said shoulder and a closure flange foldable over onto said closure lid, said apparatus comprising:

(a) a closure die member, said closure die member having
  (1) pocket means for receiving at least one of said foil containers to be closed,
  (2) means to support said generally horizontally extending shoulder of said container, and
  (3) track means extending peripherally around said pocket means, (b) and a closure tool member, said closure tool member comprising:
  (1) a handle member, and
  (2) a base member,
    (i) said handle member being rotatable with respect to said base member,
    (ii) said base member having cam means engageable with said closure flange of said foil container to effect folding of said closure flange onto said closure lid,
  (3) and key means carried by said base member insertable into said track means and movable therein to effect folding of said closure flange onto said closure lid.

2. An apparatus for closing foil containers as defined in claim 1 wherein said pocket means is circular.

3. An apparatus for closing foil containers as defined in claim 1 wherein said pocket means is substantially rectangular.

4. An apparatus for closing foil containers as defined in claim 1 wherein said pocket means is substantially elliptical.

5. An apparatus for closing foil containers as defined in claim 1 including means to retain said closure die on a work surface.

6. An apparatus for closing foil containers as defined in claim 5 wherein said means to hold said closure die on a work surface consists of a plurality of resilient members.

7. An apparatus for closing foil containers as defined in claim 1 wherein said pocket means includes means to prevent rotation of said container.

8. An apparatus for closing foil containers as defined in claim 7 wherein said means to prevent rotation of said container consists of members within said pocket means having a high coefficient of friction with respect to aluminum.

9. An apparatus for closing foil containers as defined in claim 1 wherein said base member is generally rectangular in plan view and said key means serves to orient said base member to position said cam means for proper engagement with the closure flange of said container.

10. A method of closing foil containers of the type having a generally horizontally extending shoulder for supporting a closure lid and an upstanding closure flange foldable over onto a closure lid, said method comprising the steps of (a) filling said container with a product, (b) placing a closure lid for said container on said generally horizontally extending shoulder,
(c) inserting said container into a pocket means of a die closure member,
(d) progressively folding the upstanding flange of said container in a single direction onto said closure lid by means of
  (1) inserting a hand-held closure tool in track means surrounding said pocket means,
  (2) and camming said upstanding flange means of said container onto the upper surface of said closure lid by advancing said tool member in said track means surrounding said pocket means.

11. A method of closing foil containers as defined in claim 10 including the step of preventing said container from rotation while advancing said tool member in said track means by lining said pocket means with resilient means having a high coefficient of friction with respect to aluminum.

12. A method of closing foil containers as defined in claim 10 including the additional step of manually folding down a portion of the upstanding flange of said container immediately adjacent the cam means on said tool member before beginning to advance said tool member in said track means.

13. A hand-held tool member for use in closing foil containers of the type having a generally horizontally extending shoulder for supporting a closure lid, a closure lid received on said shoulder, and a peripherally extending upstanding closure flange on said container, said tool member comprising:

(a) a base member having an upstanding post member secured thereto,
(b) a handle member rotatably mounted on said upstanding post member,
(c) cam means on said base member engageable with said peripherally extending upstanding closure flange to fold said flange onto said closure lid,
(d) and key means extending downwardly from said base member engageable with a mating track in a mold for holding said container.

14. A hand-held tool member as defined in claim 13 wherein said base member is substantially rectangular and is provided with cam means on two diagonally opposed corners.

15. A hand-held tool member as defined in claim 14 wherein said key means serves to orient said base member with the mating track of the mold so that one of said diagonally opposed cams is in position for contact with the closure flange of said container when said key means is inserted into the mating track of the mold.

16. A hand-held tool member as defined in claim 13 wherein the camming surfaces of said base member is made from a wear resistant material having a low coefficient of friction.

17. A hand-held tool member as defined in claim 14 wherein the camming surfaces of said base member are made from Zytel.

18. A hand-held tool member as defined in claim 14 wherein the camming surfaces of said base member are made from Delrin.

* * * * *